US007845277B2

(12) United States Patent
Brisighella, Jr. et al.

(10) Patent No.: US 7,845,277 B2
(45) Date of Patent: Dec. 7, 2010

(54) HEADER ASSEMBLY

(75) Inventors: Dario G. Brisighella, Jr., Logan, UT (US); Michael Perry Jordan, South Weber, UT (US); David Oral Ballam, Wellsville, UT (US); Glade Alan Merrell, Tremonton, UT (US); Jeffery Greg Baugh, Perry, UT (US)

(73) Assignee: Autoliv ASP, Inc., Ogden, UT (US)

( * ) Notice: Subject to any disclaimer, the term of this patent is extended or adjusted under 35 U.S.C. 154(b) by 22 days.

(21) Appl. No.: 12/128,348

(22) Filed: May 28, 2008

(65) Prior Publication Data

US 2009/0293752 A1 Dec. 3, 2009

(51) Int. Cl.
*F42B 3/12* (2006.01)

(52) U.S. Cl. ..... 102/202.14

(58) Field of Classification Search ..... 102/202.14, 102/202.5, 202.7, 202.9, 202.11, 202.12, 102/530, 531; 86/1.1, 10; 280/736, 741
See application file for complete search history.

(56) References Cited

U.S. PATENT DOCUMENTS

| | | | | |
|---|---|---|---|---|
| 3,541,961 | A * | 11/1970 | Larson | 102/202.6 |
| 4,137,847 | A | 2/1979 | Osborne | |
| 4,208,967 | A | 6/1980 | Betts | |
| 4,265,177 | A | 5/1981 | Lundborg et al. | |
| 4,306,499 | A * | 12/1981 | Holmes | 102/202.4 |
| 4,989,515 | A | 2/1991 | Kelly et al. | |
| 5,429,691 | A | 7/1995 | Hinshaw et al. | |
| 5,686,691 | A | 11/1997 | Hamilton et al. | |
| 6,454,306 | B1 * | 9/2002 | Cunningham et al. | 280/806 |
| 6,553,914 | B2 * | 4/2003 | Hosey et al. | 102/530 |
| 6,612,241 | B2 | 9/2003 | Avetisian | |
| 6,709,537 | B2 | 3/2004 | Hamilton | |
| 6,716,417 | B2 | 4/2004 | Rabinowitz et al. | |
| 6,779,456 | B2 | 8/2004 | Avetisian | |
| 6,905,562 | B2 | 6/2005 | Hamilton | |
| 6,976,430 | B2 * | 12/2005 | Kinoshita et al. | 102/202.5 |
| 7,004,071 | B2 | 2/2006 | Avetisian et al. | |
| 7,063,019 | B2 | 6/2006 | Parks et al. | |
| 7,284,488 | B2 | 10/2007 | Maruyama et al. | |
| 2005/0115453 | A1 * | 6/2005 | Takahara et al. | 102/530 |
| 2005/0126416 | A1 | 6/2005 | Clark | |
| 2005/0258159 | A1 | 11/2005 | Hale et al. | |
| 2005/0268911 | A1 | 12/2005 | Cross et al. | |
| 2006/0061077 | A1 * | 3/2006 | Hansen | 280/741 |

* cited by examiner

*Primary Examiner*—Bret Hayes
(74) *Attorney, Agent, or Firm*—Sally J Brown; Harness, Dickey & Pierce, PLC

(57) ABSTRACT

A header assembly for an initiator may include a first conductive pin, a second conductive pin, and a connector extending between and electrically connected to the first conductive pin and the second conductive pin. A housing may support the first conductive pin, the second conductive pin, and the connector and may include at least one flange extending away from the housing and above the pins. The at least one flange may include at least one opening to facilitate attachment of the connector to the first conductive pin and the second conductive pin.

25 Claims, 3 Drawing Sheets

HEADER ASSEMBLY

FIELD

The present disclosure relates to a header assembly and more particularly to a header assembly for an initiator.

BACKGROUND

The statements in this section merely provide background information related to the present disclosure and may not constitute prior art.

Initiators may be used in a wide range of applications to supply rapid and intense heat to a device. For example, an initiator may be used in conjunction with an inflator of an airbag assembly in initiation of a chemical reaction, in pharmaceutical devices, in initiation of other energetic events such as mining activities, initiation of heating or pressurization, or other chemical reactions in medical devices or diagnostic equipment. When used in conjunction with an inflator, the initiator may selectively ignite a volume of gas disposed within the inflator to fill an airbag of the airbag assembly in response to an impact event experienced by a vehicle. When used in conjunction with certain medical devices, the igniter may selectively supply heat to the substrate to initiate the reaction of an additional chemical composition.

Conventional initiators typically include a pyrotechnic material disposed on a distal end of a header assembly which, when energized, ignites and supplies heat rapidly to an area generally surrounding the pyrotechnic material. While conventional initiators adequately supply heat when the pyrotechnic material is ignited, performance of such initiators may be degraded if the pyrotechnic material is cracked and/or misaligned relative to the header assembly of the initiator. Pyrotechnic material used in conventional initiators may be prone to such cracking and/or misalignment, as such pyrotechnic material is typically disposed on an open, outer surface of the header assembly. Furthermore, because the pyrotechnic material is typically disposed at an open, distal end of the header assembly, the amount of pyrotechnic material employed by the initiator is typically limited and is difficult to apply during manufacturing of the header assembly. Additionally, the primary pyrotechnic material is typically consolidated onto the bridgewire or ignition element. This header/bridgewire subassembly may be inserted directly into the pyrotechnic material to provide the required intimate contact to aid in rapid initiation of additional pyrotechnic output compositions. The method herein described does not require this intimate contact or consolidation.

SUMMARY

A header assembly for an initiator may include a first conductive pin, a second conductive pin, and a connector extending between and electrically connected to the first conductive pin and the second conductive pin. A housing may support the first conductive pin, the second conductive pin, and the connector and may include at least one flange extending away from the housing and above the pins. The at least one flange may include at least one opening to facilitate attachment of the connector to the first conductive pin and the second conductive pin.

A header assembly for an initiator may include a first conductive pin, a second conductive pin, and a connector extending between and electrically connected to the first conductive pin and the second conductive pin. A housing may support the first conductive pin, the second conductive pin, and the connector and may include a pair of diametrically disposed flanges extending from a top surface of the housing. The pair of diametrically disposed flanges may define a pair of diametrically disposed openings.

A header assembly for an initiator may include a first conductive pin, a second conductive pin, and a connector extending between and electrically connected to the first conductive pin and the second conductive pin. A housing may support the first conductive pin, the second conductive pin, and the connector. The housing may include at least one opening extending through a sidewall thereof and in communication with the pyrotechnic region.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
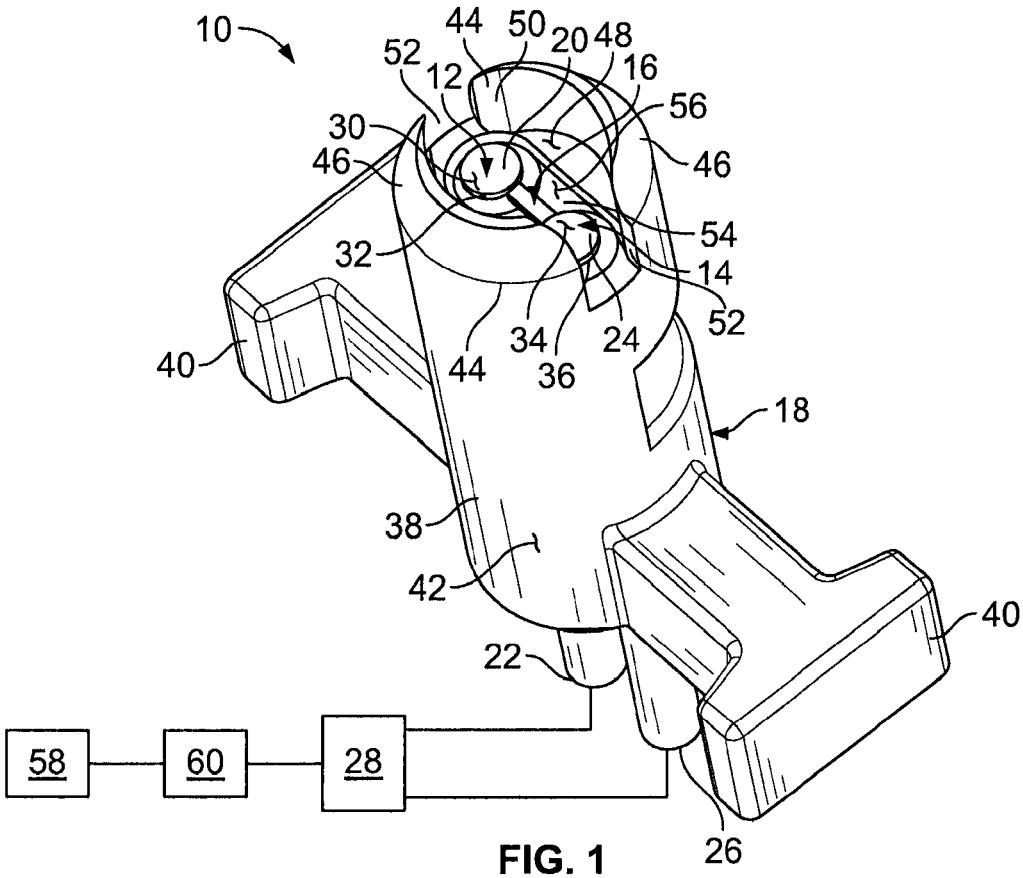
FIG. 1 is a perspective view of a header assembly in accordance with the principles of the present disclosure.

The following description is merely exemplary in nature and is not intended to limit the present disclosure, application, or uses. It should be understood that throughout the drawings, corresponding reference numerals indicate like or corresponding parts and features.

With reference to the figures, a header assembly 10 for use in an initiator (not shown) is provided and may include a first conductive pin 12, a second conductive pin 14, a connector 16, and a housing 18. The connector 16 may extend between and may be electrically connected to the first conductive pin 12 and the second conductive pin 14. The housing 18 may support each of the first conductive pin 12, second conductive pin 14, and connector 16 and may facilitate positioning the first conductive pin 12, second conductive pin 14, and connector 16 relative to a pyrotechnic material (not shown) to selectively ignite the pyrotechnic material.

The first conductive pin 12 may be formed of any suitable conductive material and may include a first end 20 and a second end 22. Similarly, the second conductive pin 14 may be formed of any suitable conductive material and may include a first end 24 and a second end 26. The first end 20 of the first conductive pin and the first end 24 of the second conductive pin 14 may extend from the housing 18 for attachment to the connector 16. The second end 22 of the first conductive pin 12 and the second end 26 of the second conductive pin 14 may extend from an opposite end of the housing 18 for connection to a power source 28. The first conductive pin 12 and second conductive pin 14 may include an outer diameter substantially equal to 0.02 inches if used in any initiator having an outer diameter of substantially equal to 0.08 inches. Alternatively, the first conductive pin 12 and second conductive pin 14 may include an outer diameter substantially equal to 0.04 inches if used in any initiator having an outer diameter substantially equal to 0.32 inches.

The connector 16 may be electrically connected to the first end 20 of the first conductive pin 12 and may be electrically connected to the first end 24 of the second conductive pin 14 such that the connector 16 electrically couples the first conductive pin 12 and second conductive pin 14. The connector 16 may be formed from any suitable conductive material that permits electrical communication between the first conductive pin 12 and the second conductive pin 14 when the power source 28 is energized. The connector 16 may be a bridgewire, a semiconductor bridge (SCB), a thin-film bridge, a fiber optic coupled laser firing signal device, or a direct laser diode firing signal device. The connector 16 may include square wire or a wire strip that is bridgewire welded to the first conductive pin 12 and the second conductive pin 14. Attaching the connector 16 to the first conductive pin 12 and the second conductive pin 14 provides an electrical connection between the first conductive pin 12 and the second conductive pin 14, as will be described in greater detail below.

The connector 16 may be attached to at least one of a top surface 30 of the first conductive pin 12 and a side surface 32 of the first conductive pin 12. Similarly, the connector 16 may be attached to at least one of a top surface 34 of the second conductive pin 14 and a side surface 36 of the second conductive pin 14. Regardless of the particular location of attachment, the connector 16 may be welded to the first conductive pin 12 and second conductive pin 14 using any suitable welding process. While a welding process is disclosed, any method of electrically attaching the connector 16 to the conductive pins 12, 14 such as, for example, soldering, brazing, may alternatively or additionally be employed.

The housing 18 may include a main body 38 and a pair of support arms 40 extending from and attached to the main body 38. The main body 38 and support arms 40 may be formed from an insulating material such as, for example, a polymer plastic material. Forming the main body 38 and support arms 40 from a polymer plastic material allows the main body 38 and support arms 40 to be integrally formed during an injection-molding process. Furthermore, forming the main body 38 and support arms 40 from a polymer plastic material allows the main body 38 of the housing 18 to insulate the first conductive pin 12 from the second conductive pin 14 along a length of each of the first conductive pin 12 and the second conductive pin 14. While the housing 18 is described as being formed from a polymer plastic material and via an injection-molding process, the housing 18 could be formed from any insulating material and from any manufacturing process that permits attachment of the support arms 40 to the main body 38 and insulates the first conductive pin 12 from the second conductive pin 14.

The support arms 40 may include any shape and may be positioned at any location along an outer surface 42 of the main body 38. The support arms 40 may be used to attach and hold the main body 38 relative to an external device such as, for example, an inflator of an automotive-airbag system or a substrate of a device to be initiated (i.e., a heating device; neither shown). Because the header assembly 10 may be used in various external devices, the position of the support arms 40 relative to the main body 38 may be dictated by the attachment method of the header assembly 10 to the external device and, therefore, may be positioned at any radial position around the main body 38.

The housing 18 may also include a pair of flanges 44 extending generally from the main body 38. The flanges 44 may be integrally formed with the main body 38 of the housing 18 and may include a chamfer 46 disposed at a distal end thereof. The chamfer 46 may facilitate insertion of the flanges 44 and, thus, the main body 38 into an external device such as, for example, an inflator of an airbag system or a heating device (neither shown).

The flanges 44 may cooperate with a top surface 48 of the main body 38 to define a pocket 50 for receiving pyrotechnic material (not shown) therein. The pyrotechnic material may be inserted into the pocket 50 as a slurry or, alternatively, may be formed as a dry granule and loaded into the pocket 50 during manufacturing of the header assembly 10. Cooperation between the flanges 44 and the top surface 48 of the main body 38 allows for the application of the pyrotechnic material without requiring consolidation steps following application of the pyrotechnic material. For example, because the flanges 44 maintain the pyrotechnic material generally within the pocket 50 and, further, because the pyrotechnic material may bond to a plurality of components (i.e., the first conductive pin 12, the second conductive pin 14, the connector 16, the flanges 44, and the top surface 48 of the main body 38), further consolidation steps to maintain the pyrotechnic material generally at a top portion of the header assembly 10 are generally not required.

The flanges 44 may also cooperate to define at least one opening 52 in communication with the pocket 50. While the housing 18 may include any number of openings 52, the housing 18 will hereinafter be shown in the drawings as including a pair of openings 52 disposed generally between the flanges 44. Furthermore, while the flanges 44 and openings 52 may be positioned at any location around a perimeter of the main body 38, the pair of flanges 44 and pair of openings 52 will hereinafter be shown and described as being diametrically opposed.

As shown in FIG. 1, the openings 52 may extend generally from the top surface 48 of the main body 38 to a distal end of each flange 44. The openings 52 may be positioned relative to the first end 20 of the first conductive pin 12 and relative to the first end 24 of the second conductive pin 14 to permit attachment of the connector 16 to the conductive pins 12, 14. Specifically, the openings 52 permit access to the first end 20 of the first conductive pin 12 and to the first end 24 of the second conductive pin 14 to permit welding and/or brazing equipment to enter the pocket 50 and attach the connector 16 to the conductive pins 12, 14.

In addition to providing access to the first conductive pin 12 and second conductive pin 14 during manufacturing of the header assembly 10, the openings 52 also may act as a path for allowing vapor and/or energy to escape the housing 18. For example, when the pyrotechnic material is loaded into the pocket 50, the pyrotechnic material may be loaded as a slurry and, therefore, must cure prior to use of the header assembly 10. Depending on the particular pyrotechnic material used, vapor may be emitted during curing of the pyrotechnic mixture. Such vapor may escape the pocket 50 and, thus, the housing 18, as the wet pyrotechnic material cures via openings 52.

In addition to providing an escape path for vapor emitted from curing pyrotechnic material, the openings 52 may provide direction to energy generated during ignition of the pyrotechnic material. For example, when the power source 28 applies electrical energy to the first conductive pin 12 and the second conductive pin 14, energy is transmitted to the connector 16 and causes ignition of the pyrotechnic material and a subsequent release of heat. The heat caused by ignition of the pyrotechnic material may be dissipated from the pocket 50 via openings 52, which may be located at any position relative to the main body 38 to direct the heat in a desired direction.

The flanges 44 may extend generally above the top surface 48 of the housing 18 and, therefore, may increase the ability of the header assembly 10 in receiving pyrotechnic material. Specifically, the flanges 44 help retain the pyrotechnic material adjacent to the top surface 48 of the main body 38 and, as such, permit a greater volume of pyrotechnic material to be positioned adjacent to the top surface 48 of the main body 38. Positioning a greater volume of pyrotechnic material adjacent to the first conductive pin 12, second conductive pin 14, and connector 16 increases the output of the header assembly 10 and associated initiator. Without the flanges 44, the pyrotechnic material would be deposited on the top surface 48 of the main body 38 and may overflow and run down the outer surface 42 of the main body 38 if excess amounts of pyrotechnic material were placed on the top surface 48.

The openings 52 may include a width that permits a wet slurry of pyrotechnic material to be deposited within the pocket 50 during manufacturing of the header assembly 10 without allowing the wet pyrotechnic material to escape the pocket 50. For example, the openings 52 include a width that restricts flow of wet pyrotechnic material out of the pocket 50 during manufacturing of the header assembly 10 to maximize the amount of pyrotechnic material disposed within the pocket 50. The openings 52 may include a greater width if the pyrotechnic material inserted into the pocket 50 includes a higher viscosity (i.e., is closer to a cured state) when applied.

The pocket 50 may be generally defined between the flanges 44 and the top surface 48 of the main body 38. The pocket 50 may also include a recess 54 that receives the first end 20 of the first conductive pin 12 and the first end 24 of the second conductive pin 14. The recess 54 may extend between the first conductive pin 12 and the second conductive pin 14 such that the connector 16 is generally received within the recess 54. The recess 54 may include a top surface 56 that is recessed from the top surface 48 of the main body 38. The top surface 56 may be positioned in close proximity to a bottom portion of the connector 16 to support the connector 16 during assembly and use of the connector 16. While the top surface 56 of the recess 54 is described as being in close proximity to the connector 16, the top surface 56 of the recess 54 may alternatively be spaced apart from the connector 16 such that a gap is provided between the top surface 56 and the connector 16. If a gap is provided between the top surface 56 and the connector 16, the pyrotechnic material may fill the gap when the pyrotechnic material is installed into the pocket 50.

The first end 20 of the first conductive pin 12 and the first end 24 of the second conductive pin 14 may extend above the top surface 56 of the recess 54 and above the top surface 48 of the main body 38 to expose both the top surface 30 and side surface 32 of the first conductive pin 12 and the top surface 34 and side surface 36 of the second conductive pin 14. Exposing the side surfaces 32, 36 of the conductive pins 12, 14 allows a mold (not shown) that forms the housing 18 to adequately seal the insulating material of the housing 18 against the side surfaces 32, 36 of the conductive pins 12, 14. Allowing engagement of the insulating material of the housing 18 to fully engage an outer perimeter of each of the conductive pins 12, 14 improves the ability of the housing 18 in insulating the first conductive pin 12 from the second conductive pin 14 and also aids in immobilizing the conductive pins 12, 14. Immobilizing the conductive pins 12, 14 prevents relative movement between the conductive pins 12, 14 and the housing 18 and, as such, reduces the likelihood that stresses are applied to a junction between the first conductive pin 12 and the connector 16 and to a junction between the second conductive pin 14 and the connector 16. Reducing the forces applied at junctions of the conductive pins 12, 14 and the connector 16 reduces the likelihood of causing a fracture at either junction and, therefore, reduces the likelihood that electrical communication between the first conductive pin 12 and the second conductive pin 14 via the connector 16 will be lost.

With continued reference to FIG. 1, operation of the header assembly 10 will be described in detail. Once the pyrotechnic material is installed into the pocket 50 and is cured, the header assembly 10 may be used to initiate an external device such as, for example, an airbag assembly or a drug-delivery system. In either system, electrical energy may be supplied to the first conductive pin 12 and the second conductive pin 14 via the power source 28. A sensor 58 may be in communication with a controller 60 and may provide the controller 60 with an indication as to when to supply electrical current to the conductive pins 12, 14. For example, the sensor 58 may be a crash sensor and may supply a signal to the controller 60 that an impact event has occurred and an airbag inflator of the airbag assembly should be deployed. The controller 60, upon receiving the signal from the sensor 58, may apply a signal to the power source 28 to supply the first conductive pin 12 and second conductive pin 14 with energy. Energizing the first conductive pin 12 and second conductive pin 14 similarly energizes the connector 16 which, when energized, ignites the pyrotechnic material disposed within the pocket 50.

Ignition of the pyrotechnic material disposed within the pocket 50 causes a rapid burst of heat, which may be used to initiate the external device. For example, the burst of heat supplied by the ignited pyrotechnic material may be used to ignite a chemical gas generant disposed within an inflator of the airbag assembly. Alternatively, the burst of heat may be used to initiate the heating reaction of a chemical composition. In either application, the heat released during ignition of the pyrotechnic material may be used to initiate an external system. While an airbag system and a drug-delivery system are disposed, the header assembly 10 may be used with any ignition system and is not limited as such.

Figure 2:
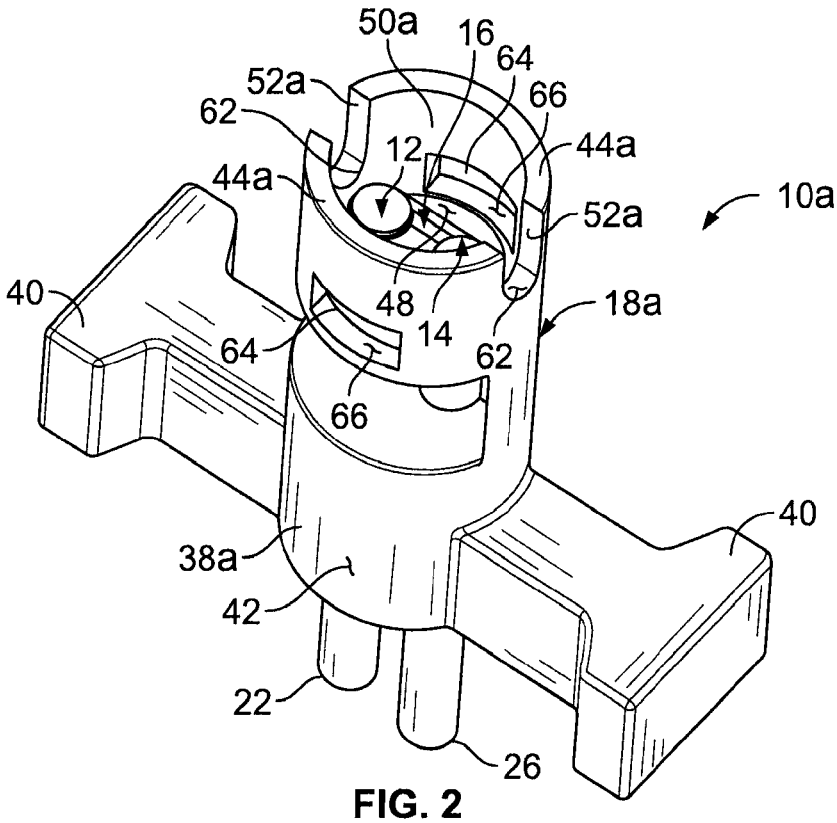
FIG. 2 is a perspective view of a header assembly in accordance with the principles of the present disclosure.

With particular reference to FIG. 2, a header assembly **10*a* is provided. In view of the substantial similarity in structure and function of the components associated with the header assembly 10 with respect to the header assembly 10*a***, like reference numerals are used hereinafter and in the drawings to identify like components, while like reference numerals containing letter extensions are used to identify those components that have been modified.

The header assembly **10*a* may include a first conductive pin 12, a second conductive pin 14, a connector 16, and a housing 18*a*. The housing 18*a* may include a pair of flanges 44*a* defining a pair of openings 52*a*. As with the header assembly 10, the number of flanges 44*a* and number of openings 52*a* is not limited to a single pair of flanges 44*a* and a single pair of openings 52*a***.

The flanges **44*a* may be disposed on opposite sides of the main body 38*a* such that the flanges 44*a* are diametrically opposed. Similarly, the openings 52*a* may be disposed on opposite sides of the main body 38*a* such that the openings 52*a* are diametrically disposed. The openings 52*a* may extend from a top surface 48 of the main body 38*a* to a distal end of each flange 44*a*. A bottom portion of each opening 52*a* may include an arcuate surface 62 that aids in directing vapor and/or heat from a pocket 50*a* defined generally by the flanges 44*a* and openings 52*a***.

The flanges **44*a* may each include an aperture 64 extending therethrough. The aperture 64 may include any shape and may be disposed at any location on the respective flange 44***a*. For example, the aperture 64 may include a generally rectangular shape, as shown in FIG. 2 or, alternatively, could include a generally circular shape. Regardless of the particular shape of the aperture 64, the aperture 64 extends generally from an outer surface 42 of the main body 38*a* and into the pocket 50*a* such that the apertures 64 are in fluid communication with the pocket 50*a*. In addition to including any shape, the aperture 64 may also include at least one inclined surface 66 that defines a profile of the aperture 64. The position of the aperture 64 relative to the flange 44*a* in combination with the overall shape of the aperture 64 may be tailored to direct energy generated during ignition of a pyrotechnic material disposed within the pocket 50*a* in a particular direction or towards a particular location. In addition, the apertures 64 may facilitate release of vapor generated during curing of the pyrotechnic material disposed within the pocket 50*a*. While the housing 18*a* is shown to include a pair of apertures 64, the housing 18 may include any number of apertures 64 positioned at any location on either flange 44*a*.

Figure 3:
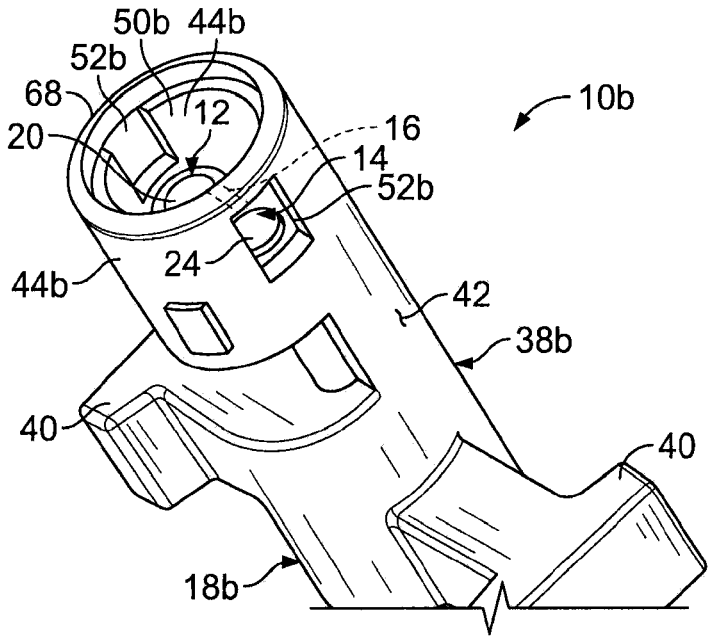
FIG. 3 is a perspective view of a header assembly in accordance with the principles of the present disclosure.

With particular reference to FIG. 3, a header assembly 10*b* is provided. In view of the substantial similarity in structure and function of the components associated with the header assembly 10 with respect to the header assembly 10*b*, like reference numerals are used hereinafter and in the drawings to identify like components while like reference numerals containing letter extensions are used to identify those components that have been modified.

The header assembly 10*b* may include a first conductive pin 12, a second conductive pin 14, a connector 16, and a housing 18*b*. The housing 18*b* may include a main body 38*b* and a pair of flanges 44*b* extending therefrom, which may cooperate to define a pair of openings 52*b*. A ring 68 may be disposed at a distal end of each flange 44*b* and may extend across each opening 52*b*. The ring 68 may cooperate with each flange 44*b* to define the shape of each opening 52*b*. The openings 52*b* may include a size that is large enough to permit access to each conductive pin 12, 14 to allow attachment of the connector 16 to each of the conductive pins 12, 14. The ring 68 may be fixedly attached at the distal end of each flange 44*b* to strengthen the flanges 44*b* and prevent damage to the housing 18*b* when installed into an external device and during ignition of the pyrotechnic material.

As with the header assembly 10 and header assembly 10*a*, the openings 52*b* may also be used to allow vapor to escape from the pocket 50*b* when the pyrotechnic material disposed therein cures and to direct heat from the ignited pyrotechnic material. Therefore, the openings 52*b* may be positioned at any location around the main body 38*b* provided the openings 52*b* extend through the flanges 44*b* and communicate with the pocket 50*b*.

Figure 4:
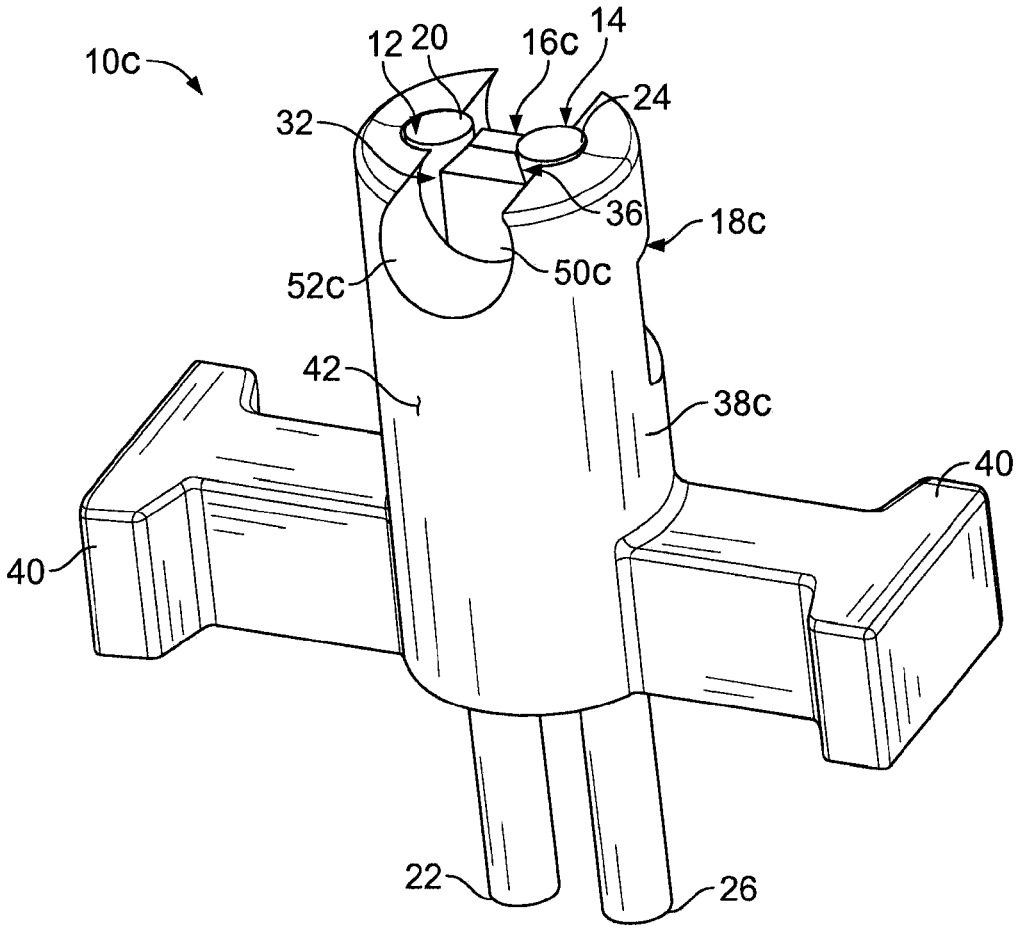
FIG. 4 is a perspective view of a header assembly in accordance with the principles of the present disclosure.

With particular reference to FIG. 4, a header assembly 10*c* is provided. In view of the substantial similarity in structure and function of the components associated with the header assembly 10 with respect to the header assembly 10*c*, like reference numerals are used hereinafter and in the drawings to identify like components while like reference numerals containing letter extensions are used to identify those components that have been modified.

The header assembly 10*c* may include a first conductive pin 12, a second conductive pin 14, a connector 16*c*, and a housing 18*c*. The housing 18*c* may include a pair of openings 52*c* that are formed into a main body 38*c* of the housing 18*c*. The openings 52*c* may extend generally from an outer surface 42 of the main body 38*c* and may be in communication with a pocket 50*c*.

The pocket 50*c* may receive a pyrotechnic material disposed therein, whereby the pyrotechnic material generally surrounds the connector 16*c* and conductive pins 12, 14. Because material is removed from the main body 38*c* to form the openings 52*c*, more pyrotechnic material may be inserted into the pocket 50*c* and retained therein within the openings 52*c*.

In addition to allowing use of a greater volume of pyrotechnic material, the openings 52*c* may also allow vapor and/or heat to escape the housing 18*c*. As described above, when the pyrotechnic material cures, vapor may be released. The openings 52*c* may provide a path by which vapor escapes the housing 18*c*. Also, when the pyrotechnic material is ignited by the connector 16*c*, the heat generated due to ignition of the pyrotechnic material may be directed away from the housing 18*c* via the openings 52*c*.

While the header assembly 10 is the only assembly shown in conjunction with a power source 28, a sensor 58, and a controller 60, each of the header assemblies 10*a*, 10*b*, and 10*c* may similarly be in communication with a power source 28, a sensor 58, and a controller 60. Furthermore, each of the header assemblies 10, 10*a*, 10*b*, and 10*c* may be used in conjunction with any external system that requires heat as an ignition source. For example, as described above with regard to the header assembly 10, each of the header assemblies 10, 10*a*, 10*b*, and 10*c* may be used to initiate firing of an airbag system or to initiate the heating reaction of a chemical composition or other reaction initiation such as initiation of reaction that requires a local increase in energy to then propagate on its own.

Figure 5:
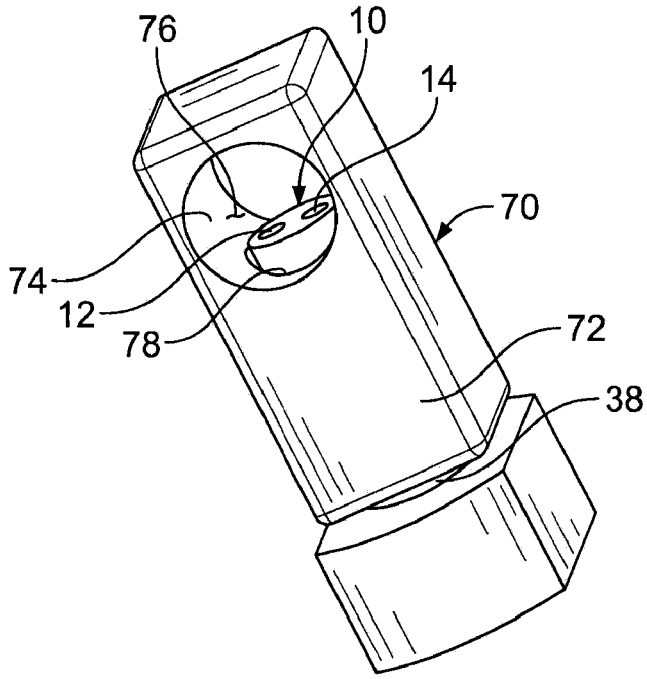
FIG. 5 is a perspective view of a director for use with any of the header assemblies of FIGS. 1-4.

With particular reference to FIG. 5, a director 70 is provided for use with the header assembly 10. While the director 70 will be described and shown hereinafter as being associated with header assembly 10, the director 70 could also be used with each of header assemblies 10*a*, 10*b* and 10*c*.

The director 70 may include a main body 72, a first bore 74, and a second bore 78. The first bore 74 may extend generally through the main body 72. The second bore 78*a* may be in communication with the first bore 74 and may extend at least partially along a length of the main body 72 for receiving the main body 38 of the housing 18. The first bore 74 may include an inner surface 76 in fluid communication with a top portion of the header assembly 10. Providing the inner surface 76 of the first bore 74 in communication with the top portion of the header assembly 10 allows the inner surface 76 of the first bore 74 to generally oppose the pyrotechnic material disposed within the pocket 50 of the header assembly 10.

With continued reference to FIG. 5, operation of the director 70 in conjunction with the header assembly 10 will be described in detail. When the connector 16 is supplied with energy and the first conductive pin 12 and the second conductive pin 14 ignite the pyrotechnic material in close proximity to the connector 16, the resulting energy generated may be guided by the director 70. Specifically, when the energy is released due to ignition of the pyrotechnic material, the energy may contact the inner surface 76 of the first bore 74 and be directed in a predetermined direction. As can be appreciated, the specific orientation of the director 70 relative to the header assembly 10 will largely be driven based on the initiator into which the header assembly 10 and director 70 are installed. If, for example, the header assembly 10 and director 70 are installed in an automotive air bag system, the director 70 may be positioned such that the energy generated due to ignition of the pyrotechnic material is directed generally toward an inflator to initiate the inflator and cause an air bag to rapidly inflate.

Figure 6:
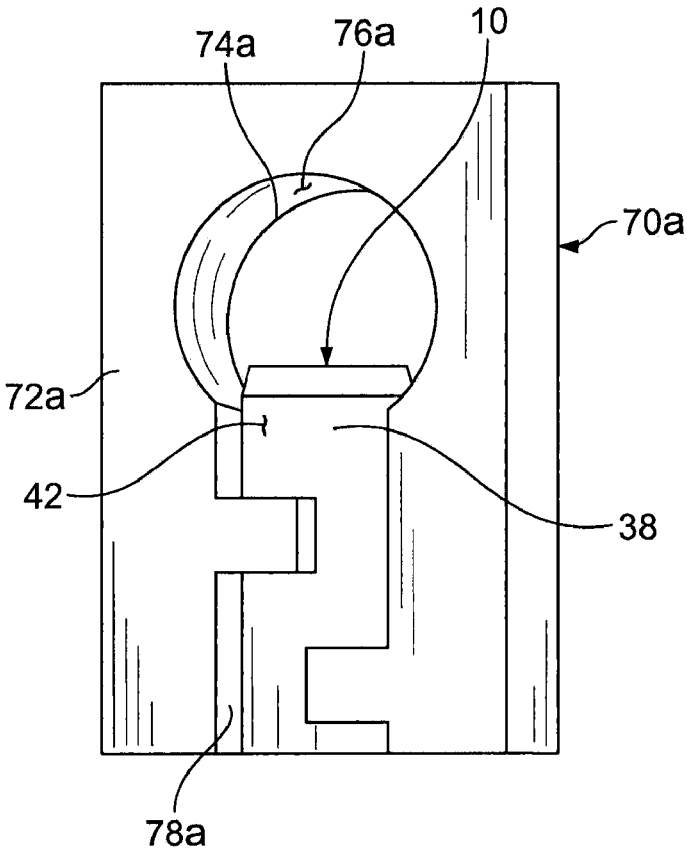
FIG. 6 is a perspective view of a director for use with any of the header assemblies of FIGS. 1-4.

With particular reference to FIG. 6, a director 70*a* is provided. In view of the substantial similarity in structure and function of the components associated with the director 70 with respect to the director 70*a*, like reference numerals are used hereinafter in the drawings to identify like components while like reference numerals containing letter extensions are used to identify those components that have been modified.

The director 70*a* may include a main body 72*a*, a first bore 74*a*, and a second bore 78*a*. As with director 70, the first bore 74*a* may extend generally through the main body 72*a* while the second bore 78*a* extends at least partially along a length of the main body 72*a* and is in fluid communication with the first bore 74*a*. The first bore 74*a* may include an inner surface 76*a*, that cooperates with the header assembly 10 to direct energy in a predetermined direction.

The second bore 78*a* may receive the main body 38 of the housing 18 to attach the director 70*a* to the header assembly 10. As such, a top portion of the header assembly 10 may extend into the first bore 74*a* such that the top portion of the header assembly 10 generally opposes the inner surface 76*a* of the first bore 74*a*. While the director 70*a* is shown as including a second bore 78*a* that extends substantially through the main body 72*a*, the second bore 78*a* may be at least partially closed by the main body 72*a* such that the main body 72*a* defines a cavity, whereby the main body 38 of the housing 18 is surrounded by the main body 72*a* at the second bore 78*a*.

With continued reference to FIG. 6, operation of the director 70*a* and header assembly 10 will be described in detail. When energy is supplied to the first conductive pin 12 and the second conductive pin 14, the energy is transmitted from the first conductive pin 12 and the second conductive pin 14 generally to the connector 16 extending therebetween. Supplying energy to the connector 16 causes the pyrotechnic material to ignite, thereby releasing heat and energy. The heat and energy may contact the inner surface 76*a* of the first bore 74*a* and be directed generally away from a top portion of the header assembly 10. The relative position of the director 70*a* relative to the header assembly 10 may be adjusted to guide the energy and heat released due to ignition of the pyrotechnic material in a predetermined direction.

As with the director 70 and header assembly 10 described above, positioning the director 70*a* relative to the header assembly 10 generally guides the heat and energy released due to the ignition of the pyrotechnic material. If, for example, the director 70*a* and header assembly 10 are installed in an igniter for an automobile air bag system, the first bore 74*a* may be positioned relative to an inflator of the automotive air bag system such that the inner surface 76*a* of the first bore 74*a* directs the heat and energy released due to the ignition of the pyrotechnic material generally toward an inflator the automotive air bag system. Directing the heat and energy released from the pyrotechnic material generally toward the inflator causes the inflator to rapidly fill an air bag of the automotive air bag system.

While specific examples have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and any appended claims.

What is claimed is:

1. A header assembly for an initiator, the header assembly comprising:

a first conductive pin;

a second conductive pin;

a connector extending between and electrically connecting said first conductive pin and said second conductive pin; and a housing supporting said first conductive pin, said second conductive pin, and said connector and including at least one flange extending away from said housing and above said pins, said at least one flange including at least one opening extending through a sidewall thereof to facilitate attachment of said connector to said first conductive pin and said second conductive pin.

2. The header assembly of claim 1, wherein said at least one flange includes a pair of flanges cooperating to define said at least one opening.

3. The header assembly of claim 1, wherein said at least one flange includes a chamfer on a distal end thereof.

4. The header assembly of claim 1, wherein said at least one opening includes a pair of openings.

5. The header assembly of claim 1, wherein said connector is one of a bridge wire, a semiconductor bridge, a thin film bridge, a fiber optic coupled laser firing signal device, and a direct laser diode firing signal device.

6. The header assembly of claim 1, further comprising a ring extending across a top portion of said at least one opening.

7. The header assembly of claim 1, wherein said housing includes a raised surface extending generally toward said connector to reduce a distance between a top surface of said housing and said connector.

8. The header assembly of claim 1, wherein said connector is formed of a square wire or a wire strip.

9. The header assembly of claim 1, further comprising a pyrotechnic material attached to said housing adjacent to said at least one flange, said at least one flange maintaining said pyrotechnic material in contact with said housing during curing of said pyrotechnic material.

10. The header assembly of claim 1, wherein said first conductive pin and said second conductive pin include an outer diameter substantially equal to one of 0.02 inches and 0.04 inches.

11. The header assembly of claim 1, wherein said at least one flange extends away from said housing a greater distance than said pins.

12. The header assembly of claim 1, wherein said at least one flange is integrally formed with said housing.

13. A header assembly for an initiator, the header assembly comprising:

a first conductive pin;

a second conductive pin;

a connector extending between and electrically connected to said first conductive pin and said second conductive pin; and a housing supporting said first conductive pin, said second conductive pin, and said connector and including a pair of flanges extending from a top surface of said housing a greater distance than said first conductive pin and said second conductive pin, said pair of flanges defining a pair of openings.

14. The header assembly of claim 13, wherein said pair of flanges are integrally formed with said housing.

15. The header assembly of claim 13, wherein said pair of openings extend from said top surface of said housing to a distal end of said pair of flanges.

16. The header assembly of claim 13, further comprising a ring extending across each of said openings to connect said pair of flanges.

17. The header assembly of claim 13, wherein said connector is one of a bridge wire, a semiconductor bridge, a thin film bridge, a fiber optic coupled laser firing signal device, and a direct laser diode firing signal device.

18. The header assembly of claim 13, further comprising at least one aperture formed through at least one of said pair of flanges.

19. The header assembly of claim 13, wherein a distal end of said pair of flanges includes a chamfer.

20. A header assembly for an initiator, the header assembly comprising:

a first conductive pin;

a second conductive pin;

a connector extending between and electrically connecting said first conductive pin and said second conductive pin; and a housing supporting said first conductive pin, said second conductive pin, and said connector and including a pyrotechnic region for receiving a pyrotechnic material, said housing including at least one opening extending through a sidewall thereof and in communication with said pyrotechnic region.

21. The header assembly of claim 20, further comprising a pair of flanges extending from a top surface of said housing.

22. The header assembly of claim 21, wherein said pair of flanges extend from said top surface a greater distance than said first conductive pin and said second conductive pin.

23. The header assembly of claim 21, wherein said pair of flanges define said at least one opening.

24. The header assembly of claim 21, wherein at least one of said pair of flanges includes a chamfer at a distal end thereof.

25. The header assembly of claim 20, wherein said at least one opening is disposed below said pyrotechnic region of said housing such that a distal end of said first conductive pin and a distal end of said second conductive pin extends above said at least one opening.

* * * * *